US012677889B2

(12) United States Patent
Yu et al.

(10) Patent No.: US 12,677,889 B2
(45) Date of Patent: Jul. 14, 2026

(54) COMPOSTABLE MEDICAL FACE MASK

(71) Applicant: YSL & C Limited, Hong Kong (HK)

(72) Inventors: Siu Lung Yu, Hong Kong (HK); Yuyan Song, Hong Kong (HK); Sik Chun Johnny Lo, Hong Kong (HK); Yeuk Tin Lau, Hong Kong (HK); Sui Han Sin, Hong Kong (HK)

(73) Assignee: YSL & C Limited, Hong Kong (HK)

( * ) Notice: Subject to any disclaimer, the term of this patent is extended or adjusted under 35 U.S.C. 154(b) by 0 days.

(21) Appl. No.: 18/974,760

(22) Filed: Dec. 9, 2024

(65) Prior Publication Data

US 2026/0157456 A1 Jun. 11, 2026

(51) Int. Cl.
*A41D 13/11* (2006.01)
*A41D 13/00* (2006.01)

(52) U.S. Cl.
CPC ..... *A41D 13/1161* (2013.01); *A41D 13/0002* (2013.01); *A41D 13/1192* (2013.01); *A41D 2400/52* (2013.01); *A41D 2500/30* (2013.01)

(58) Field of Classification Search
CPC ..... A41D 13/1161; A41D 13/1192; A41D 13/0002; A41D 13/11; A41D 13/1115; A41D 13/113; A41D 2400/52; A41D 2400/30; A41D 31/30; A41D 31/02; A41D 13/1107; A41D 13/1123; A41D 13/1236; A41D 31/305; A41D 31/04; A41D 31/12; A41D 31/14; A41D 2500/30; A41D 2300/20; A41D 2300/52; A41D 2400/38;

(Continued)

(56) References Cited

U.S. PATENT DOCUMENTS 11,470,892 B1 * 10/2022 Hasan ..... C25D 5/605
2005/0079379 A1 * 4/2005 Wadsworth ..... D04H 1/43838 428/684

(Continued)

FOREIGN PATENT DOCUMENTS

CN 102395720 A 3/2012
CN 113413684 A 9/2021

(Continued)

*Primary Examiner* — Rachael E Bredefeld
*Assistant Examiner* — Kevin S Albers
(74) *Attorney, Agent, or Firm* — IDEA Intellectual Limited; Sam T. Yip

(57) ABSTRACT

A compostable medical mask is provided with a printable outer non-woven layer. The outer non-woven layer includes bonded first fibers with first fiber diameters in a range from approximately 1 micron to approximately 100 microns. At least one intermediate non-woven filtration layer is provided. The intermediate non-woven filtration layer has second fibers having a second fiber diameter in a range from approximately 50 nanometers to approximately 800 nanometers. An inner non-woven layer for contacting a mask-wearer, the inner non-woven layer including bonded third fibers having third fiber diameters in a range from approximately 1 micron to approximately 100 microns. The compostable medical mask has a bacterial filtration efficiency of at least 98%, a sub-micron particulate filtration efficiency of at least 98%, a viral filtration efficiency of at least 98%, a splash resistance repelling synthetic blood at 160 mm Hg, and differential pressure of less than 5.0 mm $H_2O/cm^2$.

18 Claims, 6 Drawing Sheets

(58) Field of Classification Search
CPC ..... A41D 2500/20; A41D 2500/52; D04H 1/728; A62B 23/025; A62B 23/02; A62B 23/00; A62B 18/084; A62B 18/025; A62B 7/10; A62B 9/06
USPC ..... 128/863
See application file for complete search history.

(56) References Cited

U.S. PATENT DOCUMENTS

2007/0048358 A1* 3/2007 Schorr ..... A61K 31/785 424/443
2009/0044812 A1* 2/2009 Welchel ..... A41D 13/1161 128/207.11
2011/0154557 A1* 6/2011 Gray ..... D06M 13/46 2/206
2013/0174386 A1* 7/2013 Koenigkramer ... B65D 33/2508 24/415
2014/0065311 A1* 3/2014 Moseley ..... A41D 19/0082 523/124
2016/0015098 A1* 1/2016 Conlon ..... A41D 13/1115 29/428
2017/0361254 A1* 12/2017 Huang ..... D01D 10/00
2021/0322908 A1* 10/2021 Gopal ..... B01D 39/1623
2021/0329995 A1* 10/2021 Dietz ..... A62B 18/025
2022/0110378 A1* 4/2022 Tang ..... A62B 23/025
2022/0118295 A1* 4/2022 Busby ..... B01D 39/1692
2022/0143243 A1* 5/2022 Chen ..... A61L 2/088
2022/0219027 A1* 7/2022 Shuai ..... F24F 8/108
2023/0001339 A1* 1/2023 Pourdeyhimi ..... B01D 39/083
2023/0041267 A1* 2/2023 Zussman ..... A01N 25/10
2023/0108099 A1* 4/2023 Burkholder ..... B32B 5/022 55/486
2023/0159242 A1* 5/2023 Miranda ..... B65D 65/466 428/34.3
2023/0167591 A1* 6/2023 Soliman ..... B82Y 30/00
2023/0232919 A1* 7/2023 Zhang ..... C09D 101/08 128/206.12
2023/0292860 A1* 9/2023 Hasan ..... B01D 39/1623 128/857
2024/0017099 A1* 1/2024 Seok ..... A62B 18/025
2024/0308193 A1* 9/2024 Jakubowski ..... B32B 23/08
2024/0349826 A1* 10/2024 Dyck ..... A41D 13/11
2025/0065253 A1* 2/2025 Gong ..... D04H 3/011
2025/0161724 A1* 5/2025 Kita ..... A41D 13/1123
2025/0163621 A1* 5/2025 Song ..... D04H 1/435
2025/0360488 A1* 11/2025 Hetti ..... B01J 20/24

FOREIGN PATENT DOCUMENTS

CN 113788991 A 12/2021
TR 202017984 A2 12/2020

* cited by examiner

COMPOSTABLE MEDICAL FACE MASK

FIELD OF THE INVENTION

The present invention relates to medical face masks and, more particularly, to medical face masks that are compostable while meeting ASTM medical face mask standards.

BACKGROUND

Medical waste materials pose difficult and expensive disposal problems. Medical face masks are widely used by both medical personnel and the public at large during winter flu season or during widespread outbreaks of illness. Conventional medical face masks, as they are made of standard polymeric materials such as polypropylene, polyethylene, or polyester, cannot be recycled and end up in landfills and oceans, contributing to environmental pollution.

Due to environmental concerns, researchers and manufacturers look towards developing biodegradable alternatives for medical face masks that minimize their ecological footprint. Biodegradable masks are designed to degrade naturally over time, reducing the accumulation of plastic waste and mitigating environmental harm. However, the term "biodegradable" is often misleading since there are materials that decompose over the course of many years but release toxic by-products into the environment. Therefore, the term "biodegradable" does not imply a sufficiently stringent level of decomposability and protection of the environment.

Compostable materials are material that can break down or fully biodegrade on the order of 6 months and transform into natural elements in a compost environment. For compostable materials, ASTM-D6400 is the standard that measures whether the materials break down with this speed and lack of harmful by-products.

However, the production and adoption of compostable medical masks face several challenges that prevent their widespread adoption and effectiveness. Some of these problems include:

Performance Variability: Compostable materials used in medical masks may exhibit variability in properties such as strength, flexibility, and barrier properties compared to traditional synthetic materials. This can result in inconsistent performance and may compromise the effectiveness of the mask in providing adequate protection against pathogens. Such masks fail to meet the stringent standards required for medical masks.

Biodegradation Rate: While compostable masks are designed to degrade naturally over time, the rate of degradation can vary depending on environmental conditions such as temperature, humidity, and microbial activity. In some cases, masks may degrade too quickly, leading to reduced shelf life and durability, while in other cases, degradation may be too slow, resulting in prolonged environmental impact.

Comfort and Fit: Compostable materials may not always be odorless and offer the same level of comfort and fit as traditional synthetic materials, potentially leading to discomfort for the wearer during prolonged use. Poor fit can also compromise the seal of the mask, reducing its effectiveness in preventing the transmission of airborne particles.

Compostable medical face masks, therefore, represent a significant advancement in the field of medical protective equipment, addressing concerns related to environmental sustainability and waste management. Thus, there is a need in the art for improved medical masks made from improved compostable materials that have sufficient strength and filtration capability to meet achieve medical mask performance standards while being reproducibly manufacturable and comfortable enough for users to wear. The present invention addresses this need.

SUMMARY OF THE INVENTION

The present invention provides a compostable medical mask having an outer non-woven layer with a printable surface having a contact angle for print ink of less than approximately 90 degrees. The outer non-woven layer includes bonded first fibers with first fiber diameters in a range from approximately 1 micron to approximately 100 microns. At least one intermediate non-woven filtration layer is provided. The intermediate non-woven filtration layer has second fibers having a second fiber diameter in a range from approximately 50 nanometers to approximately 800 nanometers. An inner non-woven layer for contacting a mask-wearer, the inner non-woven layer including bonded third fibers having third fiber diameters in a range from approximately 1 micron to approximately 100 microns. The compostable medical mask has a bacterial filtration efficiency of at least 98%, a sub-micron particulate filtration efficiency of at least 98%, a splash resistance repelling synthetic blood at 160 mm Hg, and differential pressure of less than 5.0 mm $H_2O/cm^2$. The compostable nose piece has to offer strong hold with shape-memory capability in order to ensure a close fit against the user's nose. The compostable ear loops have to be elastic enough to provide secure attachment to the user's face, ensuring proper sealing while not causing discomfort to the user.

DETAILED DESCRIPTION

Figure 1:
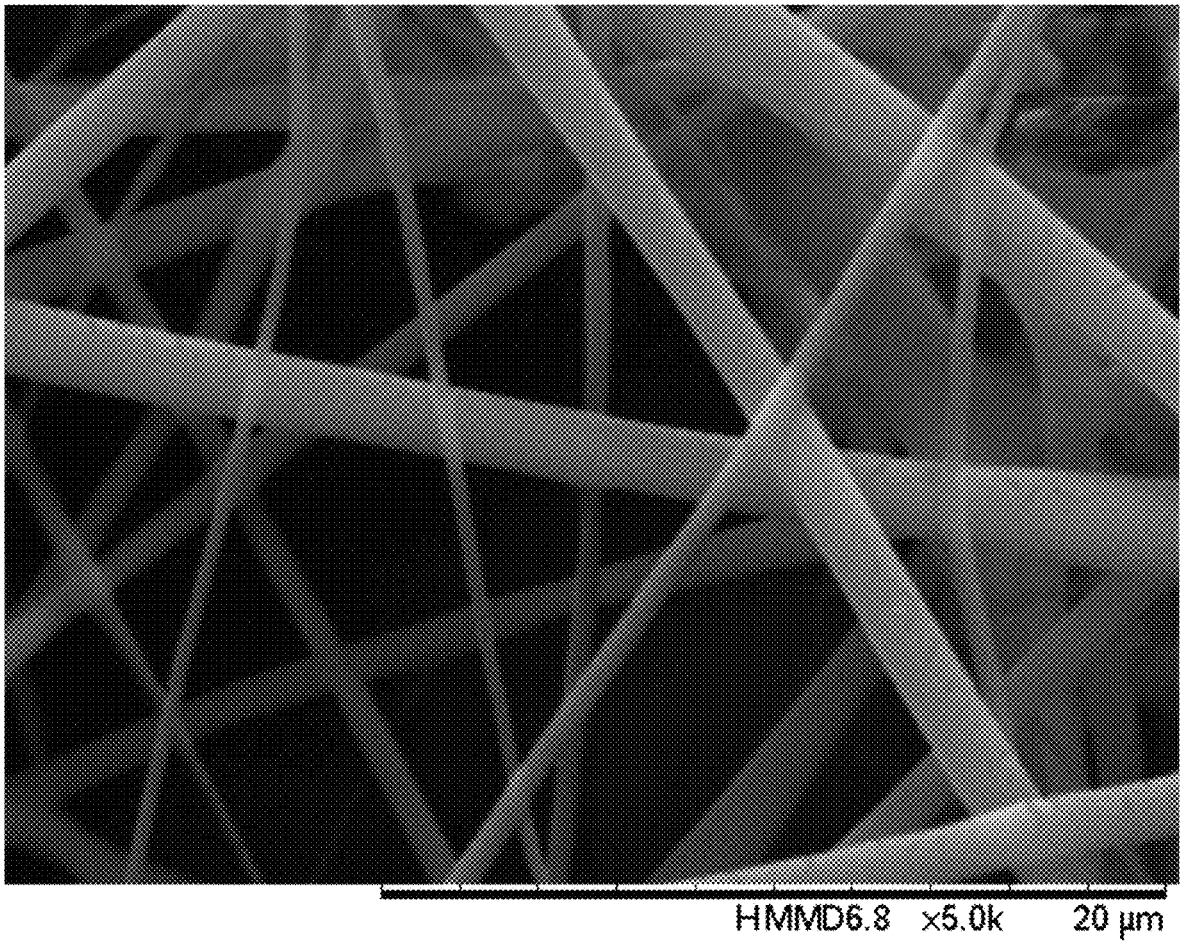
FIG. 1. is an SEM image of an electrospun fiber layer.

In the medical masks of the present invention, compostable mask fabrics are created that have sufficient strength to withstand user wear while being breathable, comfortable, and having the requisite filtration capability to function for medical purposes. In one aspect, the mask fabrics may be two-layer engineered fabrics, having a substrate layer that contributes strength and one or more upper layers that contribute high filtration properties. Compostable materials, in general, are more brittle and fragile than their non-compostable counterparts. Therefore, creating the ultrafine filter fiber layer necessary for meeting medical-grade filtration standards is extremely challenging, since ultrafine fibers made from compostable polymers can be brittle, lacking the mechanical properties necessary for wearable masks.

In order to overcome the drawbacks inherent in the use of compostable materials, the present inventors formed a compostable nanofiber layer directly on top of a mechanically-robust nonwoven fiber support fabric, creating a composite filter/fabric material. This composite filter/fabric layer can be used as part of a multilayer mask structure that includes at least one non-woven outer layer, a compostable nanofiber filter layer, and a nonwoven inner layer (the layer adjacent to the mask-wearer's face). Additionally, combinations of additives to the base compostable materials create layers that are mechanically robust, possess excellent filtration characteristics, and promote mask-wearer comfort due to the increased strength and flexibility of the created fabrics.

Various compostable polymers may be used in the compostable masks of the present invention. Compostable polymers are derived from renewable sources such as plant-based materials or products of microbial fermentation. Such compostable polymers include:

Polyhydroxyalkanoates (PHA): PHA is a family of compostable polymers produced by microorganisms under certain environmental conditions.

Starch-Based Bioplastics: These are derived from corn, potatoes, or other starch sources. These materials can be modified, grafted, and blended with other mixtures or monomers. They are used for packaging, disposable cutlery, and agricultural films.

Polylactic Acid (PLA): PLA is derived from renewable resources such as corn starch or sugarcane, making it a sustainable alternative to conventional plastics. It offers good mechanical properties and biocompatibility, making it suitable for medical applications.

Polybutylene Succinate (PBS): PBS is a compostable polyester derived from renewable resources such as plant sugars or vegetable oils. It offers good mechanical properties and compostability, making it suitable for use in medical applications.

Seaweed-Based Bioplastics: These bioplastics are derived from seaweed polysaccharides like carrageenan, agar, and alginate. Seaweed-based materials can be used for packaging, films, and other single-use items. They offer advantages such as biodegradability, low environmental impact, and reduced dependence on fossil fuels.

Chitosan: Chitosan is a biopolymer derived from the deacetylation of chitin, a natural polymer found in the exoskeletons of crustaceans such as shrimp and crabs. It exhibits antimicrobial properties and biodegradability, making it suitable for use in medical textiles.

However, as set forth above, these materials, on their own, are unsuitable to create the various mask layers with the necessary filtration and strength properties. Therefore, as described in further detail below, the above compostable polymers are combined with a variety of additives and/or reinforcements for performance enhancement. These additives may include natural fibers, such as cotton or bamboo, which provide strength and breathability, as well as natural-based hydrophobic additives, such as oils like castor/palm hemp seed oil, or natural wax like candelilla/beeswax/montan wax or plant-derived waxes, which improve water resistance.

Importantly, the fabrication techniques used to create the compostable mask layers dictate the filtration characteristics and the fabric strength. In one aspect, nonwoven spunbond fabrics are created as strong layers that can be used for the outer layer and the inner layer that contacts the user. The compostable spunbond fabric features specific characteristics such as average fiber diameter and surface density to optimize filtration performance and biodegradability.

The nonwoven spunbond fabric is formed by melting the selected compostable polymer and any additives and extruding the melt through spinnerets, which are small holes or slits arranged in a pattern. As the molten polymer emerges from the spinnerets, it is stretched into thin filaments by high-speed air or mechanical drawing. The extruded filaments are laid down onto a moving conveyor belt or drum in a random arrangement which creates a web of filaments with intersecting points, forming the basis of the non-woven fabric. The web of filaments undergoes a bonding process to strengthen the fabric and ensure cohesion. This bonding can be achieved by thermal bonding, or bonding with applied heat and pressure to fuse the filaments together. Spunbond fibers have diameters on the order of approximately 1 to 100 microns (typically in the range of 10 to 30 microns). This diameter provides sufficient fiber strength and toughness since such fiber sizes are less susceptible to breakage or deformation under stress. In the formed spunbond fabrics, the fibers are typically laid down in a random orientation, which results in a more isotropic structure with uniform strength in all directions. Thermal fusion also enhances the fabric integrity. The random fiber arrangement enhances the fabric's overall strength and tear resistance. The dense network of spunbond fibers that effectively filter out larger airborne particles and provide protection against contaminants. The surface density of the spunbond non-woven fabric ranges between approximately 10 and approximately 250 gsm.

In contrast, the filtration layer relies on ultrafine fibers, such as nanofibers, having fiber diameters from approximately 50 nanometers to approximately 800 nanometers. The filtration layer typically has a thickness ranging between approximately 1 and 100 μm. In electrospinning, a polymer solution or melt is used. The selected polymer is dissolved in a suitable solvent or melted to form a homogeneous solution or melt. The polymer solution is loaded into a reservoir connected to a metallic needle or spinneret. The spinneret is typically made of conductive material and serves as the nozzle through which the polymer solution will be extruded. The spinneret is connected to a high-voltage power supply, creating an electric field between the spinneret and a grounded collector. The high voltage applied to the spinneret induces charge accumulation on the surface of the polymer solution. As the electric field strength exceeds the surface tension of the polymer solution, a Taylor cone is formed at the tip of the spinneret. When the electrostatic repulsion overcomes the surface tension, a fine jet of polymer solution is ejected from the tip of the spinneret towards the grounded collector. During flight, the polymer jet undergoes stretching and elongation due to the electrostatic forces applied by the electric field. Simultaneously, solvent evaporation or cooling of the molten polymer occurs, leading to solidification of the polymer jet into ultrafine fibers. The electrospun fibers are collected on a grounded or rotating collector, forming a non-woven mat or membrane. The collector can be stationary, rotating, or moving in a controlled manner to control the fiber alignment, density, and morphology.

The electrospun fibers produced by this process have a high surface area-to-volume ratio, which results in unique properties such as high porosity, small pore size, and high specific surface area. These properties make the compostable electrospun fibers ideal for filtration applications, as they can effectively capture and trap particles, including bacteria and viruses, while allowing air or liquid to pass through with minimal resistance. Therefore, electrospun filtration layers provide high-efficiency particle filtration while still maintaining breathability and comfort for the wearer.

Alternatively, meltblowing spinning (for example, solution blowing spinning) may be used to produce a nanofiber filtration layer. A polymer melt or solution is extruded through a spinneret, and compressed air or gas is used to stretch and attenuate the extruded solution into fine fibers which are collected to form a nonwoven fabric.

To create a composite filter/non-woven fabric, a spunbond fabric layer is placed on an electrospinning or meltblowing spinning collector, such that an electrospun/meltblown spun layer is directly formed on the spunbond fabric layer, to form a composite filter/non-woven fabric layer. The non-woven fabric base provides support to the relatively more fragile filter layer. Formation of a composite fabric/filter layer also contributes to the manufacturability of the mask structure, since the composite layer only requires a single additional non-woven fabric layer to create the typical three-layer mask structure of disposable masks (although additional layers may be added depending upon the desired final filtration characteristics of the mask).

The composition of the compostable spunbond fabric includes a first compostable polymer and a spunbond additive, processed using extrusion and spunbonding technology. The first compostable polymer may be a polyhydroxyalkanoate, polylactic acid, polybutylene succinate, seaweed-based bioplastics, starch, chitin, poly(lactic-co-glycolic), polyethylene oxide, poly(butylene adipate-co-terephthalate), or cellulose acetate, although other compostable polymers capable of being spunbonded may be used. The spunbond additive may include nucleating agents, plasticizers, stabilizers, waterproofing agents, and antioxidants.

The electrospun nanofiber membrane comprises a second compostable polymer and nanofiber additives, prepared using electrospinning technology. The electrospinning solvents, spinneret configurations, and process parameters are carefully controlled to achieve the desired fiber characteristics and performance as set forth in the detailed processes below. Electrospinning solvents may be selected from solvents such as chloroform, dichloromethane, tetrahydrofuran, dimethylformamide, acetone, acetic acid, formic acid, etc. The nanofiber membrane may be prepared using needle spinneret, multiple spinneret, or wire spinneret electrospinning systems, with specific electrospinning conditions. These conditions include a voltage range of 20-50 kV, spinneret feeding rate range of 1-100 ml/hour, tip-to-collector distance range of 50 mm-350 mm, substrate speed range of 10-200 mm/min, temperature range of 10-50° C., and relative humidity range of 30-80%.

In one aspect, the compostable polymers and various additives may be mixed by extrusion to form modified compostable polymer pellets for use in the subsequent electrospinning or spunbond processes. Examples of forming the modified compostable polymer pellets are set forth below.

Natural-based hydrophobic additives and minerals are included in the electrospun nanofiber membrane to enhance its hydrophobicity and structural integrity. These additives contribute to the overall efficacy and durability of the mask. The concentration and molecular weight range of the second compostable polymer in the electrospun nanofiber membrane are optimized to ensure adequate filtration performance and biodegradability. For example, the nanofiber additives used are natural-based hydrophobic additives such as oils or waxes. Additionally, minerals like tetrabutylammonium chloride, sodium acetate, potassium citrate, magnesium glycerophosphate, zinc gluconate, sodium chloride, magnesium nitride, magnesium sulfate, sodium bicarbonate, potassium bitartrate, calcium carbonate, sodium lactate etc., are included. The concentration of natural-based hydrophobic additives ranges from 1% to 35%, while the concentration of minerals ranges from 0% to 5%. The polymer molecular weight ranges from 30,000 to 200,000.

In one aspect, additives are included to adjust the water contact angle of the formed material. In some embodiments, the water angle of the nanofiber or spunbond fabrics is in a range from range from 110° to 170°.

Optionally, additives may be incorporated to one or more of the non-woven and filtration layers to enhance the biodegradability of the compostable masks. Incorporating compostable additives into the mask materials can accelerate the degradation process. These additives typically include natural-based compounds or enzymes that break down the polymer chains into smaller molecules, making them more accessible to microbial activity. Enzymes produced by microorganisms can be added to the mask materials to catalyze biodegradation. These enzymes target specific chemical bonds within the polymer structure, facilitating the breakdown of the material into compostable components. Hydrophilic additives to the mask materials can increase water absorption and enhance microbial colonization and activity. This promotes the hydrolytic degradation of the polymer chains by microbial enzymes, leading to faster biodegradation. Oxidative additives such as metal oxides or peroxides can be incorporated into the mask materials to initiate oxidative degradation pathways. These additives promote the formation of free radicals, which react with polymer chains and facilitate chain scission, leading to increased biodegradability. Adding compostable fillers, such as natural fibers or particles derived from renewable sources, can increase the surface area available for microbial colonization and enzymatic degradation. These fillers act as nucleation sites for microbial activity, enhancing biodegradability. Composting accelerators, such as organic acids or microbial inoculants, can promote degradation in composting environments. These accelerators enhance microbial activity and optimize environmental conditions for biodegradation.

Figure 6A:
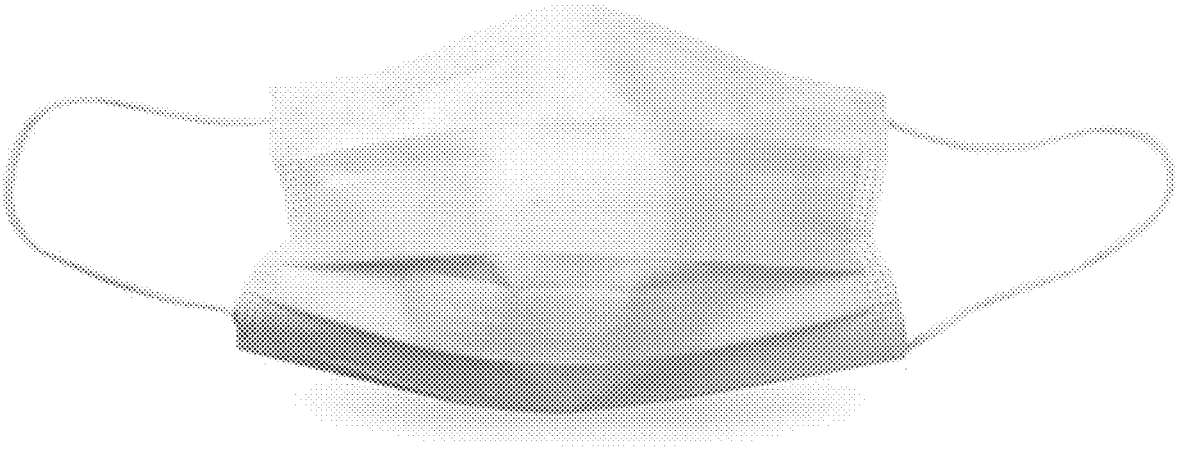
FIGS. 6A-6B show a compostable medical mask and its layer structure.
Figure 6B:
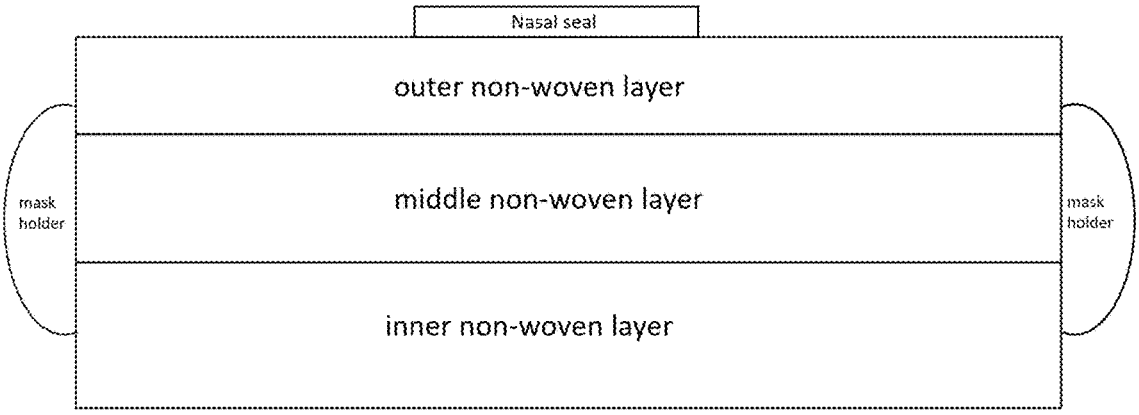

FIGS. 6A-6B depict a compostable medical mask according to one embodiment of the invention. FIG. 6A depicts the mask appearance while FIG. 6B shows the mask layer structure. In one aspect, the compostable medical mask includes at least two non-woven material layers. The mask of FIGS. 6A-6B is a three-layered medical mask designed to meet stringent ASTM performance and environmental standards. The mask comprises an outer non-woven layer, a middle non-woven layer, and an inner non-woven layer, with additional mask features including a nasal seal and mask holders for secure fitting.

The outer non-woven layer possesses a printable surface with a contact angle for print ink of less than 90 degrees, facilitating efficient printing for customization or labeling purposes. This layer acts as a barrier against external contaminants while maintaining breathability.

The middle non-woven layer serves as an additional filtration barrier, enhancing the mask's ability to filter sub-micron particles and bacteria effectively. This layer contributes to meeting the required standards for bacterial filtration efficiency (BFE), sub-micron particulate filtration efficiency (PFE) and viral filtration efficiency (VFE).

The inner non-woven layer provides comfort for the wearer and further enhances the mask's filtration capabilities. It ensures that the mask remains soft against the skin while effectively trapping respiratory droplets and other particles. This layer is also engineered to have pH around 5.7, a pH value comparable to human skin, and therefore to be skin friendly and cause fewer allergic reactions or skin rashes.

Apart from the fully compostable nose piece, various features may be included to ensure a close fit against the user's nose. Typically, deformable nose clips, formed from a strip of metal or other deformable material, foam nose pads, or adhesive nose strips may be used to seal the medical mask against the nose but any extra addition will impact the compostability. Deformable nose clips provide an adjustable and secure fit, while foam nose pads can be more comfortable for long-term wear. Adhesive nose strips may be used for a tight seal and can be provided over a large surface area. In general, any mechanical device that a user can press against the bridge of the user's nose so that the top edge of the mask conforms to the nasal bridge may be used as the nose seal of the present invention. Nose seals integrated into the mask allows for a customizable fit over the nasal bridge, reducing the likelihood of air leakage around the top of the mask.

The compostable mask holders/retainers provide secure attachment to the wearer's face, ensuring proper sealing and minimizing the risk of contamination. Similarly, mask holders may take a variety of forms, including ear loops, adjustable ear loops, head loops, mask ties, and combinations of ties. Any type of compostable or non-compostable mask holder that can affix the medical mask to the wearer's face may be used in the compostable face masks of the present invention. The mask retainer, for example, ear loops, have sufficient elasticity to securely attachment of the mask to the user's face in order to seal the mask but without causing discomfort to the user. That is, the mask retainers create a flexible seal such that movement of the user's face still maintains the seal properly.

The assembled three-layered medical mask meets the Standard Specification for Performance of Materials Used in Medical Face Masks (ASTM F2100), including requirements for bacterial filtration efficiency, sub-micron particulate filtration efficiency, splash resistance, and differential pressure. In addition to meeting medical standards, the mask also adheres to international biodegradation standards (ASTM D6400 and EN 13432), ensuring its eco-friendly disposal and minimizing environmental impact.

In the mask of FIGS. 6A-6B, the outer non-woven layer of the mask has a printable surface with a contact angle for print ink of less than 90 degrees. The assembled three-layered medical mask meets the Standard Specification for Performance of Materials Used in Medical Face Masks (as per ASTM F2100). This standard encompasses the following requirements:

a. Bacterial filtration efficiency of at least 98% (according to ASTM F2101).
b. Sub-micron particulate filtration efficiency of at least 98% (according to ASTM F2299).
c. Splash resistance, with the ability to pass the synthetic blood test at 160 mmHg (according to ASTM F1862, ISO 22609).
d. Differential pressure of less than 5.0 mm $H_2O/cm^2$ (according to EN 14683).

EXAMPLES

Various formulations of polymers and additives may be used in the compostable masks of the present invention. Particular formulations and their processing conditions are set forth below in Table 1:

TABLE 1

| Formulations | | | | | | |
|---|---|---|---|---|---|---|
| Ingredient 1 | Concentration | Ingredient 2 | Concentration | Additives | Concentration | Solvent |
| Polybutylene succinate (PBS) | 7.5-17.8% | montan wax, castor oil | 5-12% | ammonium chloride, lithium sulphate | 0.1-0.5% | Chloroform THF DCM |
| Seaweed polysaccharides + PEO | 12-35% | stearic acid, castor oil | 6-15% | Potassium chloride, lithium sulphate | 0.1-0.5% | Ionic liquid DMAc |
| Poly(amino acid) + PHA | 8-10% | castor oil, Alginates | 25-35% | Magnesium Bromide, calcium chloride | 0.1-0.5% | Acetic acid Formic acid Chloroform |
| Polylactic acid | 12-36% | Beeswax, palm oil, montan wax | 5-17% | Magnesium Bromide, sodium chloride | 0.1-0.5% | DMF DMAc Chloroform |
| Polyhydroxy alkanoate (PHA) | 25-40% | stearic acid, castor oil | 3-8% | Potassium Iodide, tetrabutyl-ammonium chloride | 0.1-0.5% | Formic acid Ionic liquid Chloroform |
| Poly(lactic-co-glycolic) + Starch + PEO | 30-46% | stearic acid, castor oil | 5-10% | Magnesium Bromide, lithium sulphate | 0.1-0.5% | Chloroform DMF DMAc |
| Cellulose | 5-15% | castor oil, montan wax, beeswax | 5-10% | Tetrabutyl-ammonium chloride, sodium chloride | 0.1-0.5% | Ionic liquid DMAc Acetic acid |
| Chitosan + Polylactic acid | 3-10% | carnauba wax, castor oil | 2-5% | Tetrabutyl-ammonium chloride, potassium Iodide | 0.1-0.5% | Acetic acid Formic acid |

In general, polybutylene succinate is typically selected for giving thermal stability, high tensile strength, and flexibility to the formed material. Seaweed polysaccharides offer desirable properties such as tensile strength, flexibility and water resistance. Poly(amino acid)/PHA provides a wide range of properties, from rigid and tough to flexible and elastic, making them suitable for various applications. Polylactic acid provides a high level of composting biodegradation while polyhydroxyalkanoate provides a better level of degradation in a marine environment. Poly(lactic-co-glycolic) acid-based materials show good biocompatibility to human skin so may be used in skin-contacting applications. Cellulose is a well-known, widely adopted biodegradable material. Finally, chitosan demonstrates anti-microbial properties. These properties are balanced in a selected fabric depending upon the particular application.

Formulation 1: Nanofiber Membrane 1.5 g of polybutylene succinate pellets are dissolved in 10 ml of mixed solvents of chloroform and THF; the ratio of chloroform and THF was 3:7 by volume. The blend is stirred at room temperature until a homogeneous solution is observed. The polybutylene succinate solution is injected to electrospinning equipment and subjected to electrospinning with the following condition: voltage: 23 kV; tip-to-collector distance: 210 mm; feed rate: 1 ml/h; substrate speed: 50 mm/min.

Formulation 2: Nanofiber Membrane 1.8 g of seaweed polysaccharide powders, 0.5 g of PEO, 0.001 g of potassium chloride are dissolved in 10 ml solvent of DMAc. The blend is stirred at room temperature until a clear homogeneous solution is observed. The seaweed polysaccharides/PEO solution are injected to the electrospinning equipment and subjected to electrospinning under the following condition: voltage: 45 kV; tip-to-collector distance: 210 mm; feed rate: 16 ml/h; substrate speed: 60 mm/min.

Formulation 3: Nanofiber Membrane 0.2 g montan wax is dissolved in 5 ml chloroform and stirred at room temperature. Then 5 ml dimethylformamide and 1.8 g polylactic acid pellets are added to the mixture.

The blend is stirred at room temperature until polylactic acid pellets are dissolved. The blend is injected to electrospinning equipment and subjected to electrospinning according to the following condition: voltage: 45 kV; tip-to-collector distance: 210 mm; feed rate: 16 ml/h; substrate speed: 60 mm/min.

Formulation 4: Spunbond Fabric

Spunbond fabric is formed by spunbonding of cellulose pellets plus minerals and other additives. The combined pellets are fed to a spunbond machine with 180° C.-220° C. spinning temperature and 70° C. bonding temperature.

Formulation 5: Spunbond Fabric

Spunbond fabric is obtained by spunbonding modified polylactic acid pellets by twin screw extrusion. To make the modified polylactic acid pellets, 640 g of PLA is mixed with 318 g of PGA, 20 g ESBO, 10 g PDMS masterbatch, 7 g TMC 300 and 5 g irganox.

Epoxidized soya bean oil (Epoxidized soybean oil, ESBO) is a non-toxic clear to yellow liquid which is manufactured from soybean oil through the epoxidation process, which include of mixed organic compounds.

The mixture is injected to a twin-screw extruder with 170° C.-180° C. operation temperature to make modified pellets. The modified pellets are fed to a spunbonding machine with 180° C.-230° C. spinning temperature and 70° C. bonding temperature.

Materials created by the above formulations are analyzed and evaluated as set forth in the tests below:

Evaluation 1: Fiber Diameters

Figure 2:
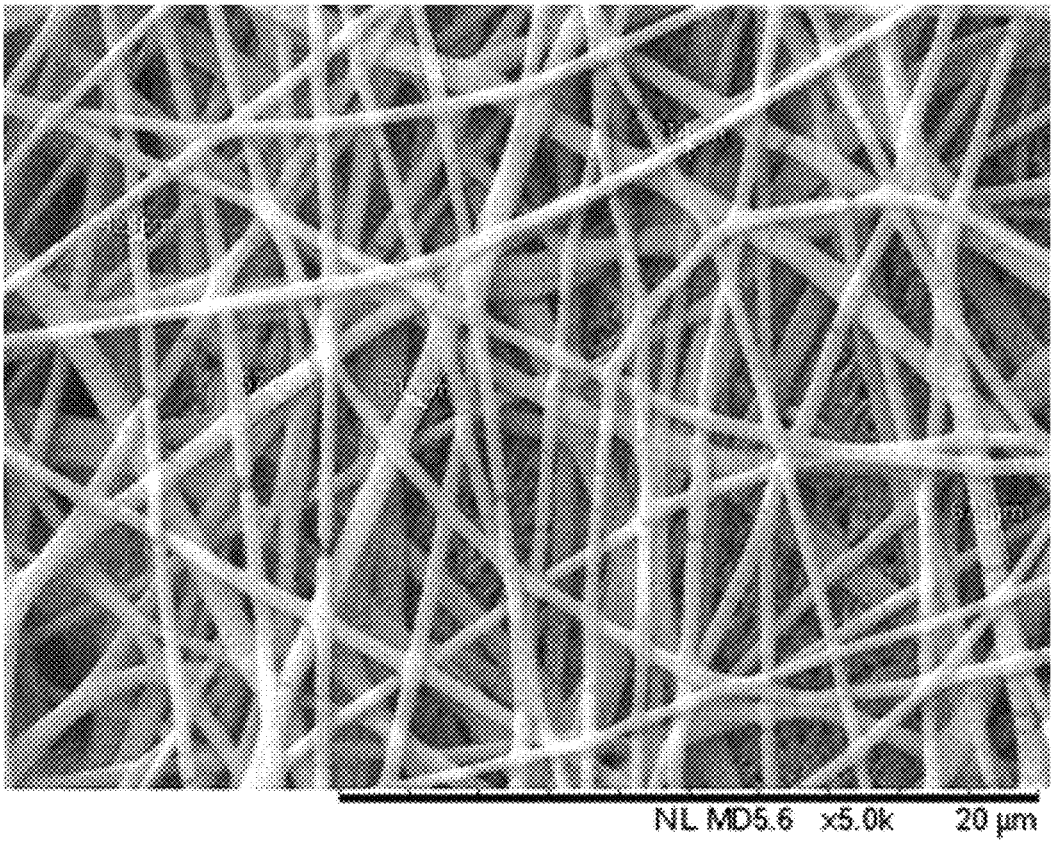
FIG. 2 is an SEM image of an electrospun fiber layer.

This example is used to compare fiber diameter of a nanofiber membrane prepared according to the above Examples. For one embodiment, the average fiber diameter was about 883 nm. For another embodiment, the average fiber diameter was about 345 nm. FIG. 1 and FIG. 2 are the SEM images of nanofiber membranes, respectively.

Evaluation 2: Splash Resistance

This example is used to compare splash resistance of spunbond fabrics prepared by formulation 4 and formulation 5. The spunbond fabrics of formulation 4 and formulation 5 were composited with one layer of nanofiber membrane prepared by formulation 1-3. The splash resistance was performed at 160 mmHg. Table 2 shows the pass rate.

TABLE 3

| Splash Resistance | |
|---|---|
| Sample | Splash resistance test pass rate |
| Formulation 4 spunbond fabric + formulation 1 nanofiber membrane | 13 pieces pass/16 pieces |
| Formulation 5 spunbond fabric + formulation 2 nanofiber membrane | 15 pieces pass/16 pieces |

Evaluation 4: Differential Pressure and Filtration Efficiency

This example is used to compare differential pressure and filtration efficiency of layers with different formulations. The nanofiber membranes and spunbond fabrics are prepared according to the above Examples. Table 4 shows the sample structure and filtration performance including differential pressure and filtration efficiency.

TABLE 4

| Filtration Efficiency | | |
|---|---|---|
| | Filtration performance | |
| Sample structure (layer structure by embodiment) | Differential pressure | Filtration efficiency |
| Formulation 4 spunbond fabric<br>Formulation 1 nanofiber membrane | 3.6 $mmH_2O$ | 93.4% |
| Formulation 4 spunbond fabric<br>Formulation 5 spunbond fabric<br>Formulation 2 nanofiber membrane<br>Formulation 2 nanofiber membrane | 4.5 $mmH_2O$ | 98.8% |

Evaluation 5: ASTM Testing for Mask Performance

Figure 3:
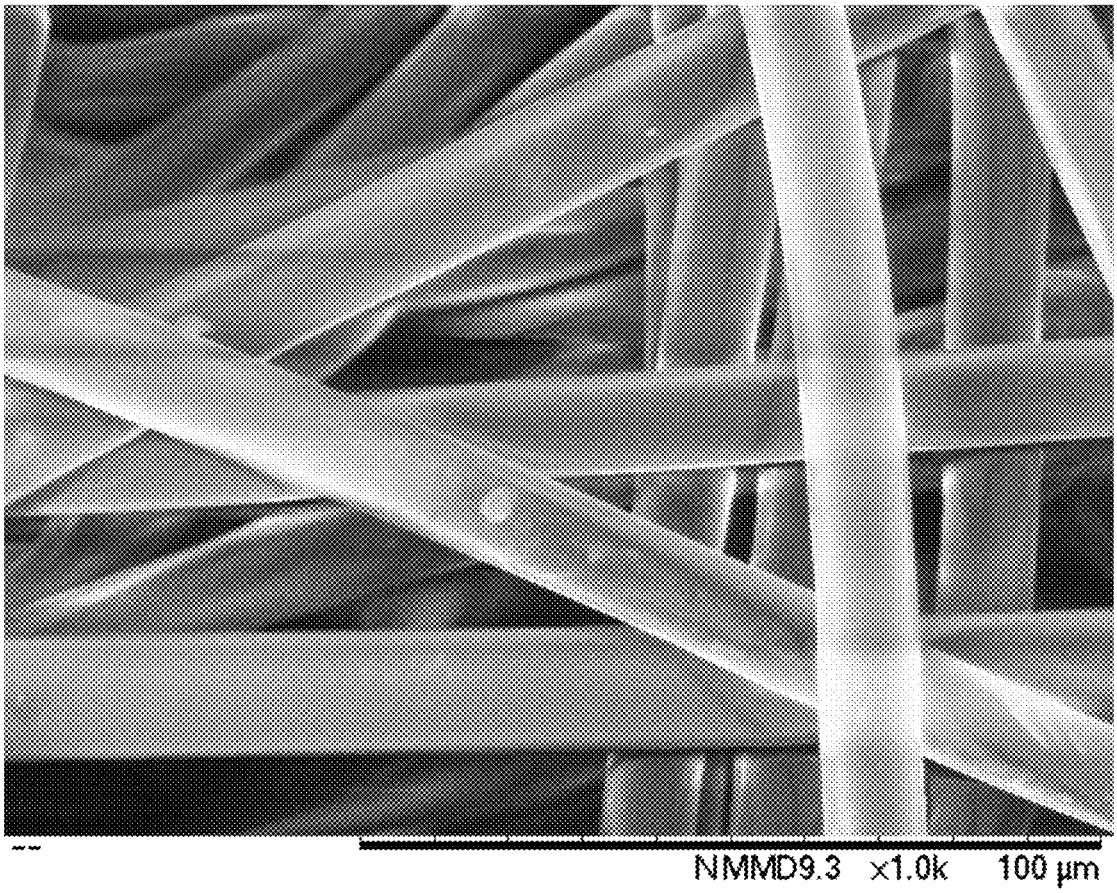
FIG. 3 is an SEM image of an electrospun fiber layer.
Figure 4:
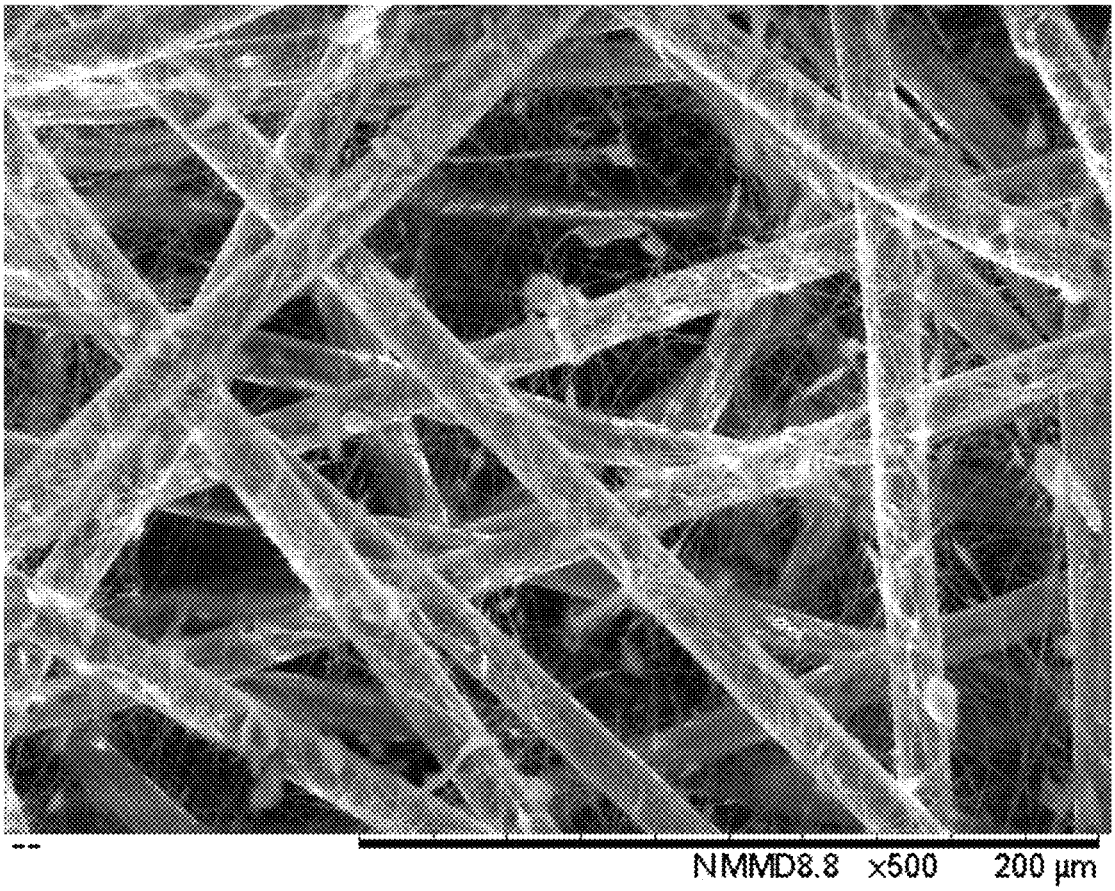
FIG. 4 is an SEM image of an electrospun fiber layer.
Figure 5:
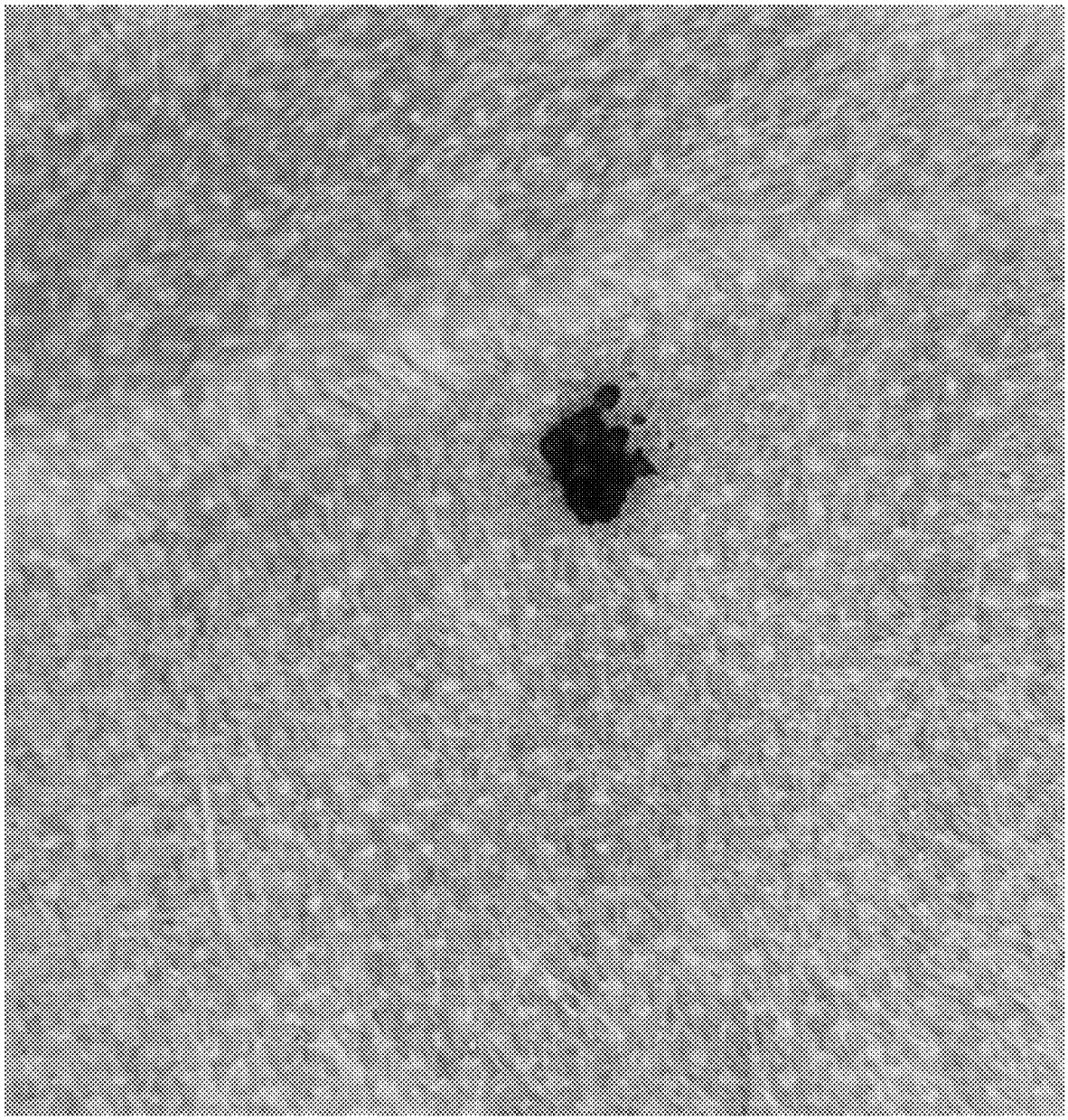
FIG. 5 depicts the wettability of a mask layer.

This example lists the specifications of compostable medical mask products made with 3 layers of non-woven fabric (outer, middle & inner layer structure). It includes nose clip and ear bands. The outer layer is spunbond fabric prepared by formulation 4 or 5 with about 13 um fiber diameter and about 30 gsm surface density and the middle and inner layer is nanofiber membrane prepared according to the above Examples with a 480 nm fiber diameter. The outer non-woven layer of the mask has a printable surface with a contact angle for print ink of less than 90 degrees. The assembled three-layered medical mask meets the Standard Specification for Performance of Materials Used in Medical Face Masks (as per ASTM F2100), encompasses the following requirement, bacterial filtration efficiency of at least 98% (according to ASTM F2101), sub-micron particulate filtration efficiency of at least 98% (according to ASTM F2299), viral filtration efficiency of at least 98% (according to modified ASTM F2101 from SGS), splash resistance, with the ability to pass the synthetic blood test at 160 mmHg (according to ASTM F1862, ISO 22609), differential pressure of less than 5.0 mm $H_2O/cm^2$ (according to EN 14683). It meets the international biodegradation standard (as per ASTM D6400 and EN 13432). All of the standards are incorporated by reference herein. Table 5 shows the performance of assembled three-layered surgical mask. FIG. 3 is the SEM image of spunbond fabrics. FIG. 4 is the SEM image of nanofiber membrane. FIG. 5 shows that the printing ink has good wettability on the outer layer of the surgical mask (the contact angle was less than 90 degree).

TABLE 5

| Mask Performance | |
|---|---|
| Bacterial filtration efficiency | 99.9% |
| Sub-micron particulate filtration efficiency | 99.0% |
| Viral filtration efficiency | 99.5% |
| Splash resistance | 32 pieces pass/32 pieces |
| Differential pressure | 4.6 mm$H_2O$ |

Evaluation 6: ASTM and EN Testing of Decomposition

The materials of the above examples were tested for compliance with ASTM D6400 and EN 13432 for compostable materials. Both standards define the conditions of biological decomposition and transformation of biodegradable materials into a humus-like substance called compost: the aerobic mesophilic and thermophilic degradation of organic matter to make compost; digestion by microorganisms to transform the biodegradable materials to carbon dioxide, water, and organic matters (compost or humus).

ASTM D5511-18 is the standard test method for determining anaerobic biodegradation of plastic materials under high-solids anaerobic-digestion conditions. 90 percent of greater of the materials listed above decomposed in 90 days under this standard.

Using the techniques of ASTM D6400, 90 percent or greater of the materials listed above decomposed in 6 months or less without toxic residue.

As used herein, for ease of description, space-related terms such as "under", "below", "lower part", "above", "upper portion", "lower portion", "left side", "right side", and the like may be used herein to describe a relationship between one element or feature and another element or feature as shown in the figures. In addition to orientation shown in the figures, space-related terms are intended to encompass different orientations of the device in use or operation. A device may be oriented in other ways (rotated 90 degrees or at other orientations), and the space-related descriptors used herein may also be used for explanation accordingly. It should be understood that when a component is "connected" or "coupled" to another component, the component may be directly connected to or coupled to another component, or an intermediate component may exist.

As used herein, terms "approximately", "basically", "substantially", and "about" are used for describing and explaining a small variation. When being used in combination with an event or circumstance, the term may refer to a case in which the event or circumstance occurs precisely, and a case in which the event or circumstance occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all the ranges disclosed in the present disclosure include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

Several embodiments of the present disclosure and features of details are briefly described above. The embodiments described in the present disclosure may be easily used as a basis for designing or modifying other processes and structures for realizing the same or similar objectives and/or obtaining the same or similar advantages introduced in the embodiments of the present disclosure. Such equivalent construction does not depart from the spirit and scope of the present disclosure, and various variations, replacements, and modifications can be made without departing from the spirit and scope of the present disclosure.

The invention claimed is:

1. A compostable medical mask comprising:

a first compostable polymer outer non-woven fabric layer with a printable surface having a contact angle for print ink of less than approximately 90 degrees, the first compostable polymer outer non-woven fabric layer including bonded first compostable polymer fibers having first compostable polymer fiber diameters in a range from approximately 1 micron to approximately 100 microns, at least one second compostable polymer intermediate non-woven filtration layer;

the at least one second compostable polymer intermediate non-woven filtration layer comprising second compostable polymer fibers having a second compostable polymer fiber diameter in a range from approximately 50 nanometers to approximately 800 nanometers;

a third compostable polymer inner non-woven fabric layer for contacting a mask wearer, the third compostable polymer inner non-woven fabric layer including bonded third compostable polymer fibers having third compostable polymer fiber diameters in a range from approximately 1 micron to approximately 100 microns;

a compostable nose piece with shape-memory capability such that, when the mask is worn by a user, a close fit against the user's nose is ensured;

a compostable mask retainer having sufficient elasticity such that, when the mask is worn by a user, the mask is secured on to the user's face, creating a flexible seal between the mask and the user's face;

wherein the first compostable polymer outer non-woven fabric layer and the at least one second compostable polymer intermediate non-woven filtration layer are both composite compostable electrospun nanofiber filtration layers formed on compostable spunbond fabric substrates;

wherein the compostable spunbond fabric substrates comprise a first compostable polymer and a spunbond additive;

wherein the electrospun nanofiber filtration layers comprise a second compostable polymer in a concentration of 3-46%, compostable hydrophobic additives in a concentration of 2-35%, and salt additives in a concentration of 0.1-0.5%;

wherein the compostable medical mask has a bacterial filtration efficiency of at least 98%, a sub-micron particulate filtration efficiency of at least 98%, a viral filtration efficiency of at least 98%, a splash resistance repelling synthetic blood at 160 mmHg, and differential pressure of less than 5.0 $mmH_2O/cm^2$.

2. The compostable medical mask of claim 1, wherein the compostable medical mask meets international biodegradation standards of ASTM D6400, EN13432 and ASTM D5511.

3. The compostable medical mask of claim 1, wherein a surface density of the first compostable polymer spunbond fabric substrates range between 10 and 250 gsm.

4. The compostable medical mask of claim 1, wherein the first compostable polymer is selected from seaweed polysaccharides, poly (amino acid), polylactic acid, polyhydroxyalkanoate, polybutylene succinate, poly (lactic-co-glycolic), polyethylene oxide, poly (butylene adipate-co-terephthalate), chitosan, or cellulose acetate, and the spunbond additive is selected from one or more of nucleating agents, plasticizers, stabilizers, waterproofing agents, and antioxidants.

5. The compostable medical mask of claim 1, wherein the second compostable polymer is selected from seaweed polysaccharides, poly (amino acid), polylactic acid, polyhydroxyalkanoate, polybutylene succinate, poly (lactic-co-glycolic), polyethylene oxide, poly (butylene adipate-co-terephthalate), chitosan, or cellulose acetate.

6. The compostable medical mask of claim 1, wherein the hydrophobic additives are one or more of candelilla wax, montan wax, beeswax, castor oil, palm oil, or hemp seed oil, and the salt additives are one or more of lithium sulphate, magnesium bromide, potassium iodide, tetrabutylammonium chloride, sodium chloride, calcium chloride, ammonium chloride, or potassium chloride.

7. The compostable medical mask of claim 1, wherein a molecular weight range of the second compostable polymer is 30,000 to 200,000 g/mol.

8. The compostable medical mask of claim 1, wherein the electrospun nanofiber filtration layer is prepared by electrospinning a compostable polymer in a solvent at a voltage from 20-100 kV, a spinneret feeding rate range of 1-200 ml/hour, a tip-to-collector distance range of 50 mm-350 mm, and a substrate speed range of 10-200 mm/min.

9. The compostable medical mask of claim 8, wherein the electrospun nanofiber filtration layer prepared by electrospinning is electrospun at a temperature range of 10-50° C. and a relative humidity range of 30-80%.

10. The compostable medical mask of claim 1, wherein the mask retaining is a pair of compostable and flexible ear loops.

11. The compostable medical mask of claim 1, wherein the electrospun nanofiber filtration layers comprise polybutylene succinate in a concentration of 7.5-17.8% as the second compostable polymer, a mixture of montan wax and castor oil in a concentration of 5-12% as the compostable hydrophobic additives, and a mixture of ammonium chloride and lithium sulphate in a concentration of 0.1-0.5% as the salt additives.

12. The compostable medical mask of claim 1, wherein the electrospun nanofiber filtration layers comprise a mixutre of seaweed polysaccharides and polyethylene oxide in a concentration of 12-35% as the second compostable polymer, a mixture of steric acid and castor oil in a concentration of 6-15% as the compostable hydrophobic additives, and a mixture of potassium chloride and lithium sulphate in a concentration of 0.1-0.5% as the salt additives.

13. The compostable medical mask of claim 1, wherein the electrospun nanofiber filtration layers comprise a mixture of poly (amino acid) and polyhydroxyalkanoate in a concentration of 8-10% as the second compostable polymer, a mixture of alginates and castor oil in a concentration of 25-35% as the compostable hydrophobic additives, and a mixture of magnesium bromide and calcium chloride in a concentration of 0.1-0.5% as the salt additives.

14. The compostable medical mask of claim 1, wherein the electrospun nanofiber filtration layers comprise polylactic acid in a concentration of 12-36% as the second compostable polymer, a mixture of beeswax, palm oil and montan wax in a concentration of 5-17% as the compostable hydrophobic additives, and a mixture of magnesium bromide and sodium chloride in a concentration of 0.1-0.5% as the salt additives.

15. The compostable medical mask of claim 1, wherein the electrospun nanofiber filtration layers comprise polyhydroxyalkanoate in a concentration of 25-40% as the second compostable polymer, a mixture of stearic acid and castor oil in a concentration of 3-8% as the compostable hydrophobic additives, and a mixture of potassium iodide and tetrabutylammonium chloride in a concentration of 0.1-0.5% as the salt additives.

16. The compostable medical mask of claim 1, wherein the electrospun nanofiber filtration layers comprise a mixture of poly (lactic-co-glycolic), starch and polyethylene oxide in a concentration of 30-46% as the second compostable polymer, a mixture of stearic acid and castor oil in a concentration of 5-10% as the compostable hydrophobic additives, and a mixture of magnesium bromide and lithium sulphate in a concentration of 0.1-0.5% as the salt additives.

17. The compostable medical mask of claim 1, wherein the electrospun nanofiber filtration layers comprise cellulose in a concentration of 5-15% as the second compostable polymer, a mixture of castor oil, montan wax and beeswax in a concentration of 5-10% as the compostable hydrophobic additives, and a mixture of tetrabutylammonium chloride and sodium chloride in a concentration of 0.1-0.5% as the salt additives.

18. The compostable medical mask of claim 1, wherein the electrospun nanofiber filtration layers comprise a mixture of chitosan and polylactic acid in a concentration of 3-10% as the second compostable polymer, a mixture of carnauba wax and castor oil in a concentration of 2-5% as the compostable hydrophobic additives, and a mixture of ammonium chloride and potassium iodide in a concentration of 0.1-0.5% as the salt additives.

* * * * *